US005802768A

United States Patent [19]

Hammer et al.

[11] Patent Number: 5,802,768

[45] Date of Patent: Sep. 8, 1998

[54] MANUALLY RELEASABLE COUPLING DEVICE FOR CONNECTING AN ELONGATE OPERATOR WITH A FRAME OR MAIN FRAME MEMBER OF A WINDOW AND A PIVOTAL CHAIN OPENER OPERATED WINDOW WITH SUCH A COUPLING DEVICE

[75] Inventors: Carl Johannes Hammer, Skjern; Ole Fejer, Grevinge, both of Denmark

[73] Assignee: V. Kann Rasmussen Industri A/S, Søborg, Denmark

[21] Appl. No.: 638,377

[22] Filed: Apr. 26, 1996

[30] Foreign Application Priority Data

Apr. 28, 1995 [DK] Denmark ..... 0505/95

[51] Int. Cl.[6] ..... E05F 11/00

[52] U.S. Cl. ..... 49/325; 403/345

[58] Field of Search ..... 49/139, 140, 324, 49/325; 403/315, 348, 353, 345, 354, 350

[56] References Cited

U.S. PATENT DOCUMENTS

| | | | |
|---|---|---|---|
| Re. 24,831 | 5/1960 | Livermont | 403/354 |
| Re. 34,287 | 6/1993 | Berner et al. | 49/325 |
| 350,896 | 10/1886 | Ruddekk | 49/325 |
| 3,066,371 | 12/1962 | Mullens | 403/353 |
| 3,881,334 | 5/1975 | Wilson . | |
| 4,009,507 | 3/1977 | Lascarrou | 403/353 |
| 4,014,136 | 3/1977 | Hemens et al. | 49/325 |
| 4,258,940 | 3/1981 | Fudge | 403/353 |
| 4,403,449 | 9/1983 | Richmond . | |
| 4,598,889 | 7/1986 | Remington | 16/260 |
| 5,380,117 | 1/1995 | Buschulte | 403/354 |
| 5,406,750 | 4/1995 | Lindgren | 49/325 |
| 5,423,106 | 6/1995 | Peyret | 403/350 |

FOREIGN PATENT DOCUMENTS

| | | | |
|---|---|---|---|
| 233931 | 5/1961 | Australia | 49/325 |
| 168405 | 3/1994 | Denmark . | |
| 169999 | 4/1995 | Denmark . | |
| 534413 | 3/1993 | European Pat. Off. . | |
| 599809 | 12/1994 | European Pat. Off. . | |
| 1271211 | 4/1972 | United Kingdom . | |

*Primary Examiner*—Daniel P. Stodola
*Assistant Examiner*—Curtis Cohen
*Attorney, Agent, or Firm*—Lane, Aitken & McCann

[57] ABSTRACT

A manually releasable coupling device for connecting an elongate operator chain (2) with a frame or main frame member of a window comprises a first coupling member (3) for connection with a free end of the operator chain (2) and a second coupling member (6–10) designed for mounting in or on the frame or main frame member. The first coupling member is a flat disc-shaped element (3) with a substantially keyhole-shaped recess 85), while the second coupling member comprises a shaft section (6) for mounting in a bore in the frame member or the main frame member in connection with a turning handle (7). The shaft section (6) has a local constriction (8) for releasable engagement with the keyhole-shaped recess (5) in the disc-shaped element (3).

In order to allow manual closing of the window under surmounting of sealing pressure, the shaft section may be eccentric relative to the rotational axis of the turning handle.

23 Claims, 4 Drawing Sheets

MANUALLY RELEASABLE COUPLING DEVICE FOR CONNECTING AN ELONGATE OPERATOR WITH A FRAME OR MAIN FRAME MEMBER OF A WINDOW AND A PIVOTAL CHAIN OPENER OPERATED WINDOW WITH SUCH A COUPLING DEVICE

BACKGROUND OF THE INVENTION

The present invention relates to a manually releasable coupling device for connecting an elongate operator means with a frame or main frame member of a window, comprising a first coupling member for connection with a free end of the operator means facing said frame or main frame member and a second coupling member designed for mounting in or on the frame or main frame member.

DK Patent No. 168405 discloses a coupling device of this type, in which the first coupling member comprises a coupling head pivotally connected with operator means, while the second coupling member comprises a basis plate element with a recess or a hole, in which a locking plate element is received. The basis plate element and the locking plate element are covered by a cover plate element with an aperture for the coupling head, and these plate elements are all positioned in mutually parallel planes. By means of an actuator means which is pivotal in a plane parallel thereto and engages the locking plate element, the locking plate element can be moved in position for locking and release, respectively, of the coupling head introduced through the aperture in the cover plate element, the locking taking place by engagement between the coupling head and edge portions of the locking plate element and the recess in the basis plate element, while an edge of the aperture in the cover plate element by release of the coupling device prevents the coupling head from following the movement of the locking plate element.

The construction of the second coupling member from several mutually co-operating individual parts with edges which with a view to a reliable functioning of locking and release have to be adapted to each other with comparatively small tolerances, complicates and makes the manufacture as well as the building in of the second coupling member in a frame or a main frame member of a window more costly.

DK Patent No. 169999 further discloses a chain operator for opening and closing a window with a releasable coupling device, wherein the first and the second coupling members are shaped as elongate profiles which may be telescoped and each has a stationary locking element at one end and a releasable locking means at the other end, such that the stationary locking element on one coupling member may be held in releasable engagement with the locking means on the second coupling member. On the first coupling member the releasable locking means comprises a prestressed, longitudinally displaceable slider, whereas on the second coupling member it comprises a tilting locking means which by means of prestress is pivotal between two stable positions for release and holding of the stationary element on the first coupling member.

This known device has the advantage that after release a renewed coupling of the two coupling members is made possible under surmounting of the sealing pressure between frame and main frame, but also here the design of the two coupling members is comparatively complicated and expensive, and the building in comparatively difficult.

SUMMARY OF THE INVENTION

In relation to these known coupling devices it is the object of the invention to provide a design which is on one hand substantially more simple in respect of the design of the coupling member, such that in particular the second coupling member easily and discreetly may be built into a frame or main frame member or may be post-mounted on an existing window, and on the other hand ensures a reliable functioning of both the locking and the release of the coupling device in a single operation, which is easy for the user to make.

This is obtained according to the invention in that the first coupling member is a flat, disc-shaped element, which at one end portion is designed for connection with said free end of the operator means and which at an opposite end portion has a substantially keyhole-shaped recess with an open, constricted mouth in connection with a circular part, while the second coupling member comprises a shaft portion for mounting in a bore in the frame or main frame member or a fixture connected therewith perpendicular to the longitudinal direction of the frame or main frame member in connection with a turning handle, said shaft section having a local constriction with substantially rectangular cross-section, which in one direction has a dimension corresponding to the width of the mouth of the recess in the first coupling member and in a direction perpendicular thereto a dimension corresponding to the diameter of the circular part of the recess, whereby said second coupling member also comprises means for holding said shaft section and turning handle onto the frame or main frame member.

In the coupling device according to the invention the operative part of the second coupling member thus comprises substantially one shaft section with said local constriction which is easy to make with the desired tolerances on an automatic tooling machine and which is moreover simple to mount either directly in the frame or main frame member or in a separate fixture to be mounted thereon, whereby the coupling device according to the invention also is suited for post-mounting on existing windows.

The functioning of the coupling device according to the invention is moreover simple and reliable, as in one position of the turning handle of the second coupling member passage of the recess in the first coupling member may take place over the local constriction on the shaft section on the second coupling member. In the inserted position locking is established by turning the second coupling member by means of the turning handle through an angle which will typically be approx. 90°.

In a further embodiment of the invention the additional advantage is obtained—in the same way as in the last-mentioned coupling device, but without its complicated coupling parts—that after release of the coupling device with a view to opening the window beyond the limited opening angle, which the operator means makes possible, a coupling of the first and the second coupling member may be made in such a way that the window frame in connection with locking of the coupling device is pulled towards the main frame under surmounting of the sealing pressure between the oppositely positioned frame and main frame members. According to the invention this embodiment is characteristic in that the shaft section with associated turning handle in the second coupling member is designed such that a part of the shaft section containing said local constriction has a longitudinal axis positioned eccentrically displaced relative to the rotational axis of the turning handle.

The coupling device according to the invention is particularly suited for use together with chain operators of the type which is for instance known from the above DK patent no. 169999 and EP published specification no. 0624703, wherein the housing of the chain operator is built into a main frame part, for instance in the bottom part of the main frame. When constructing the frame from hollow profile elements an embodiment of the coupling device according to the invention is characteristic in that the second coupling member is designed for direct mounting in a bore through the frame or main frame member which is made as a hollow element, and in that said holding means comprise a fixture to be fastened on a bottom wall of said hollow profile and provided with a guide for an end portion of the shaft section positioned opposite the turning handle.

The invention also relates to a pivotal window with a substantially rectangular main frame and a frame substantially consisting of hollow profile elements with a manual or electric chain operator for opening of the window to a ventilation position.

By use of the coupling device according to the invention such a window is according to the invention characteristic in that in a main frame member parallel with the axis of rotation of the pivotal movement of the window a housing for the chain operator is built in, that its operator chain which is passed through an opening in the main frame member in direction towards the oppositely positioned frame member which at its free end is connected with an end portion of a first coupling member shaped as a flat, disc-shaped element which at an opposite end portion has a substantially keyhole-shaped recess with a towards this portion open, constricted mouth in connection with a circular part of the recess, and in that a second coupling member is connected with the oppositely positioned frame member, said coupling member comprising a shaft portion for mounting in a bore in the frame member or a fixture for fastening thereon and being perpendicular to the longitudinal direction of the frame member in connection with a turning handle, said shaft section having a local constriction with substantially rectangular cross-section, which in one direction has a dimension corresponding to the width of the mouth of the recess in the first coupling member and in a direction perpendicular thereto a dimension corresponding to the diameter of the circular part of the recess.

BRIEF DESCRIPTION OF THE DRAWINGS

The invention will now be explained in detail in the following with reference to the schematic drawing, in which.

DETAILED DESCRIPTION OF THE PREFERRED EMBODIMENTS

Figure 1:
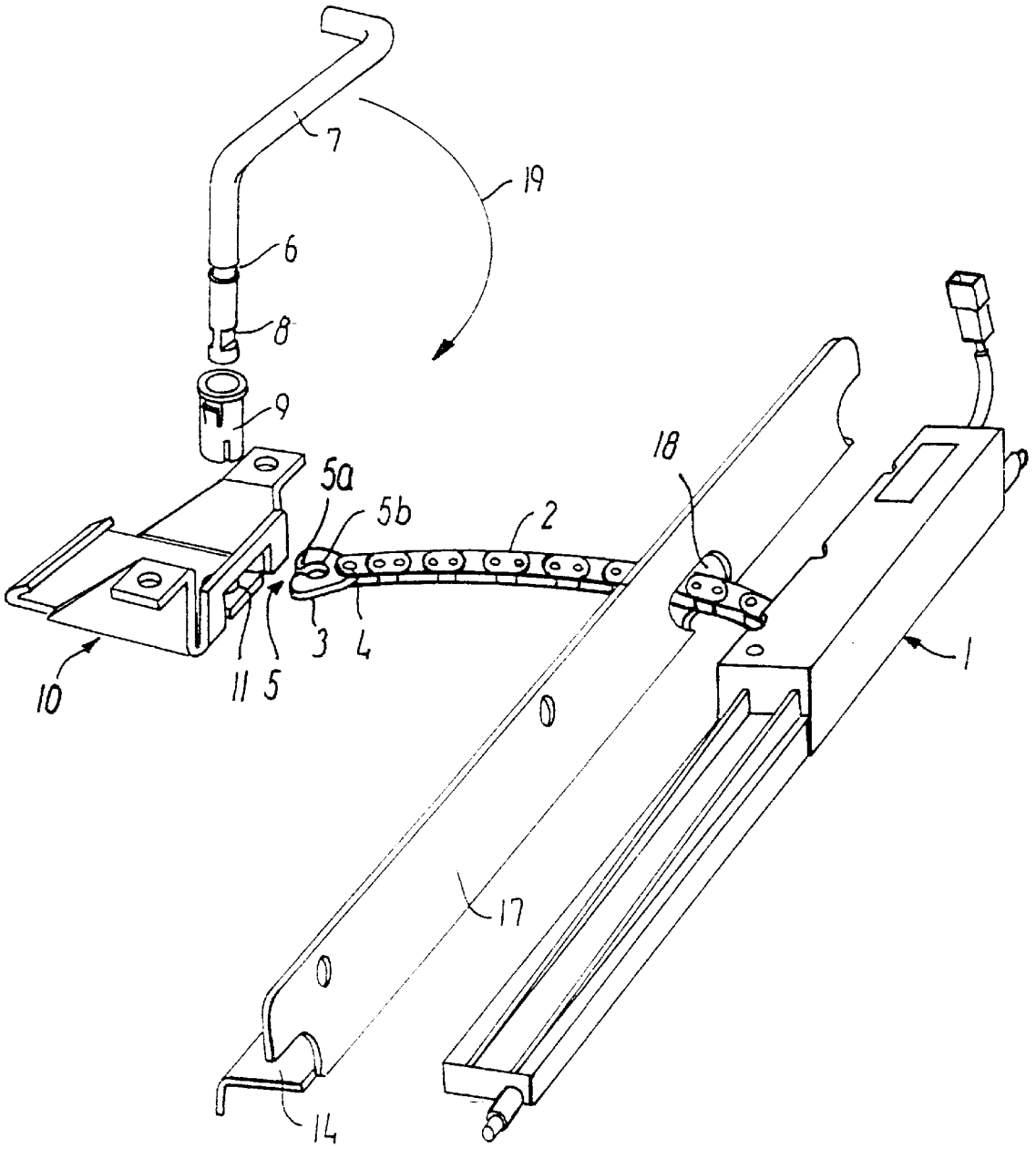
FIG. 1 is an exploded perspective view of an embodiment of the coupling device according to the invention for use with a chain operator of a design known per se.

FIG. 1 shows an electrically operated chain operator with a housing designed for being built into a main frame member of a window. The housing 1 receives the (not shown) drive and transmission means, just as the housing 1 is adapted to receive the operator chain 2 of the chain operator in the closed position of the window, which is in FIG. 1 shown as protruding from the housing 1 towards a window frame member opposite the main frame member, into which the housing 1 is built in.

According to the invention a first coupling member in form of a comparatively flat disc-shaped element 3 is connected with the outermost link of the operator chain 2, said element having at one end a hole 4 for connection with the outermost chain link by means of a rivet or the like and is at its opposite end provided with a keyhole-shaped recess 5, which is open towards the end edge, said recess comprising a constricted mouth 5*a* in connection with a substantially circular part 5*b*.

The active part of the second coupling member of the coupling device, which in the example shown is shown for being mounted in or on a frame member opposite the main frame member in which the chain operator housing 1 is built in, comprises according to the invention a shaft section 6 for mounting in a bore in the frame part in connection with a turning handle 7. The shaft section 6 is provided with a local constriction 8 with substantially rectangular cross-section, such that the constriction, as will be best seen in FIG. 4, in one direction has as a dimension a corresponding to the width of the mouth 5*a* of the recess 5 in the disc-shaped element 3 and in a direction perpendicular thereto a dimension b corresponding to the diameter of the circular part 5*b* of the recess 5.

Figure 2:
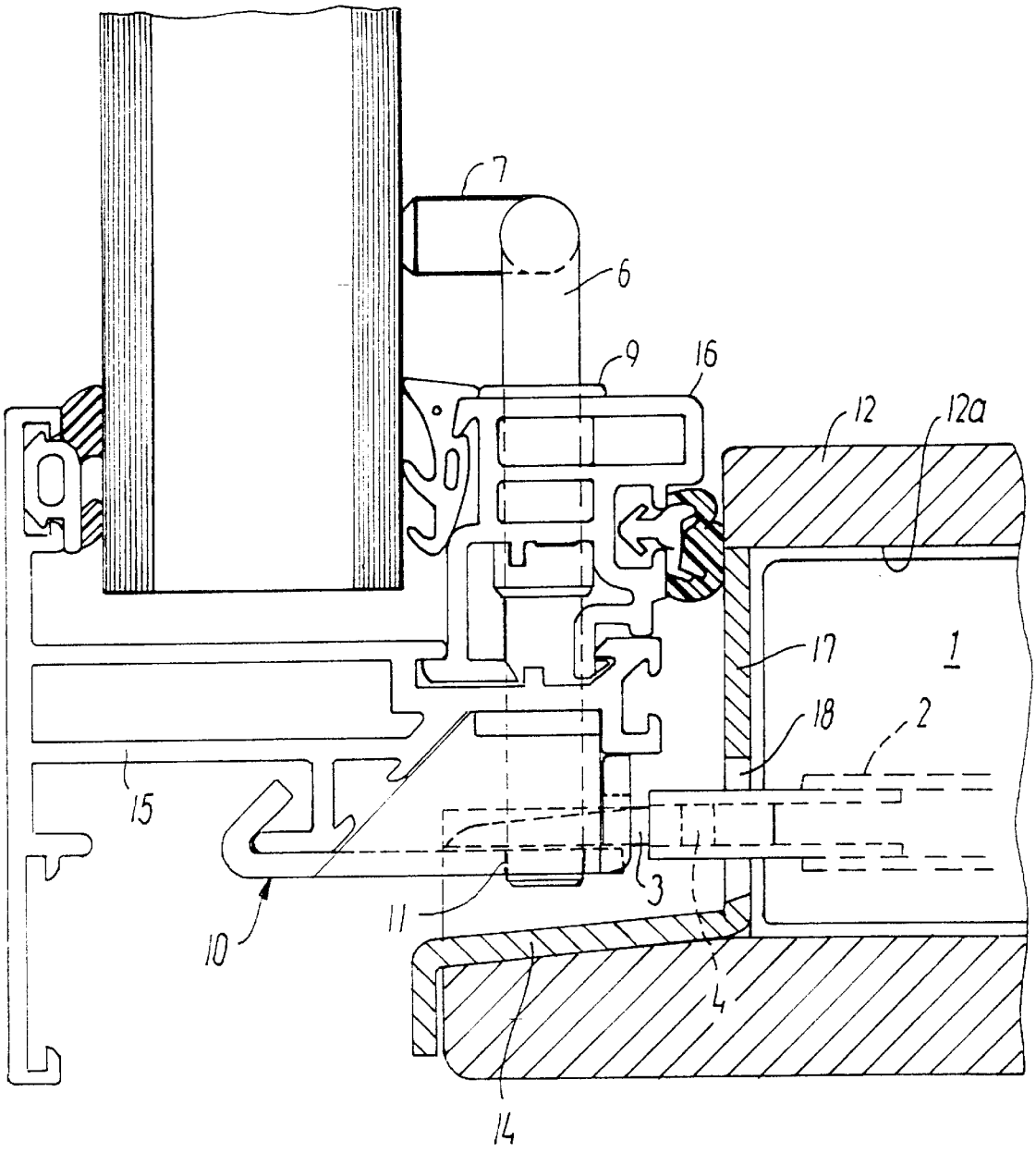
FIG. 2 is a sectional view of oppositely positioned frame and main frame members in a window for illustration of the building in of the chain operator of the embodiment shown in FIG. 1.

With a view to holding the second coupling member onto the frame part of the window, which by direct mounting in the frame part preferably consists of one or more hollow profile elements as shown in FIG. 2, the embodiment shown in FIG. 1 comprises a guide bushing 9 and a fixture 10 for mounting on a bottom wall of the hollow profile element, said fixture having a guide 11 for the end portion of the shaft section 6 positioned oppositely to the turning handle 7.

In the example shown in FIG. 2 of a window with the coupling device built in according to the invention the chain operator housing 1 is shown built in a hollow space 12*a* in a main frame member 12 designed as a wood profile. In the side facing the main frame member 12 a cover fixture 17 with an aperture 18 may be mounted, which allows passage of the operator chain 2 with the disc-shaped element 3 for engagement with the local constriction 8 on the shaft section. The cover fixture closes the aperture of the hollow space 12*a* facing the window frame and is fastened to the main frame member 12 by means of a flange portion 14 in a manner known per se.

The frame member 15, positioned opposite the main frame member 12, consists in a manner known per se of two coupled hollow profiles 15 and 16 which may for instance be of aluminium. The coupled profiles are in the horizontal profile walls provided with holes which provide a through bore for receiving the shaft section 6 of the second coupling member. In the end of the bore facing the aperture face of frame the guide bushing 9 shown in FIG. 1 is inserted, said bushing being of a plastics material, for instance nylon, while the holding fixture 10 is clipsed to the underside of the hollow profile 15 and held by means of screws to a bottom wall of this profile.

In FIG. 1 the shaft section 6 of the second coupling member and turning handle 7 are shown in a position corresponding to locking of the coupling between the two coupling members, wherein the local constriction on the shaft section 6 is prevented from being pulled out through the mouth 5*a* of the recess 5 of the disc-shaped element 3. It will immediately be realized that by turning the turning handle 7, which in the embodiment shown comprises a handle extending substantially perpendicular to the shaft section 6, approx. 90° in the direction indicated by the arrow 19, the recess 5 in the disc-shaped element 3 will unimpededly be releasable from engagement with the shaft section 6.

Figure 3:
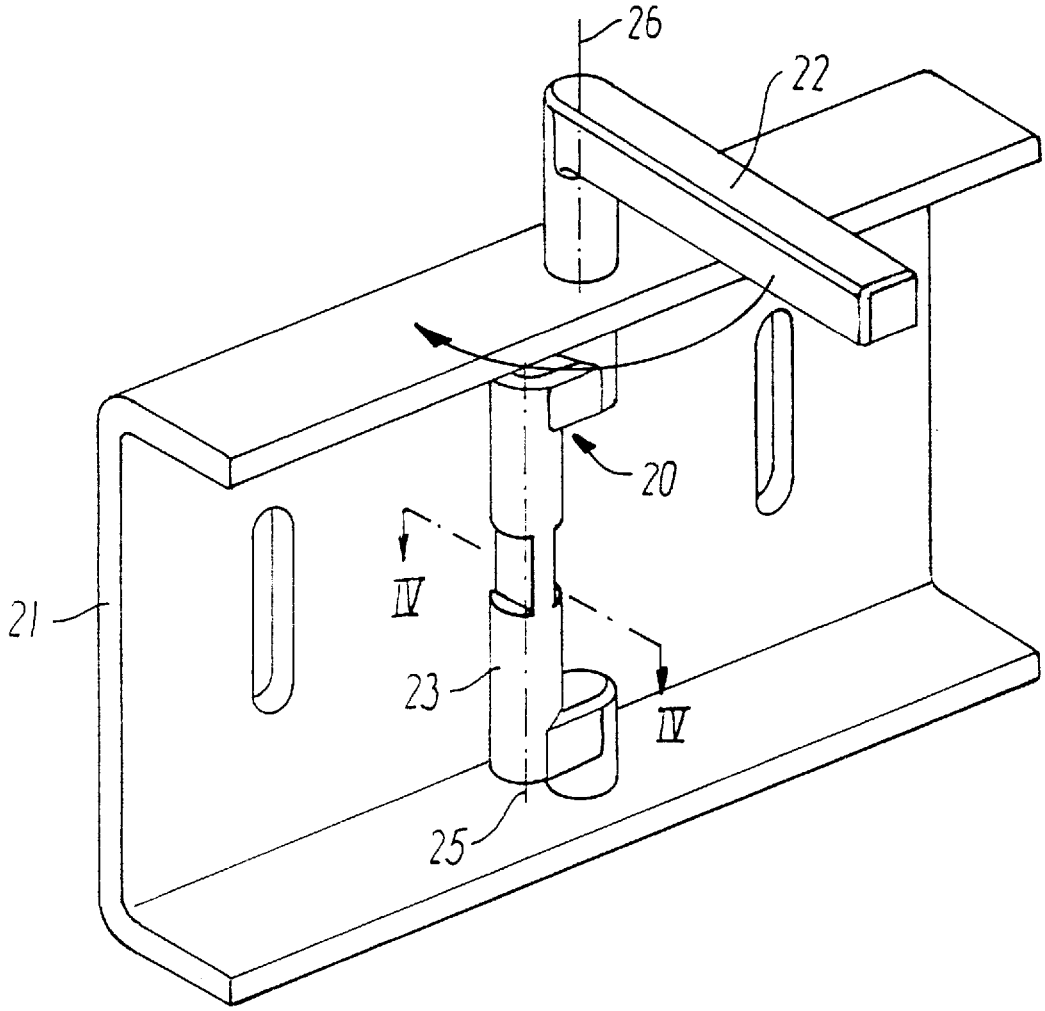
FIG. 3 is a perspective view of a second coupling member of another embodiment of the coupling device according to the invention.

In a further embodiment shown in FIG. 3 of the second coupling member the shaft section 20 is mounted in a flat, substantially U-shaped fixture profile 21, which may be fastened directly on a frame or main frame member, which makes this embodiment well suited for post-mounting on an existing window, irrespective of whether the electrically or manually controlled operator means is connected with a frame member or a main frame member.

Moreover, the shaft section 20 is in the embodiment according to FIG. 3 made such that on a part 23 of its length containing the local constriction 24 its longitudinal axis 25 is positioned eccentrically displaced relative to the rotational axis of the turning handle 22, the shaft section 20 thus getting a crank-like shape.

Figure 4:
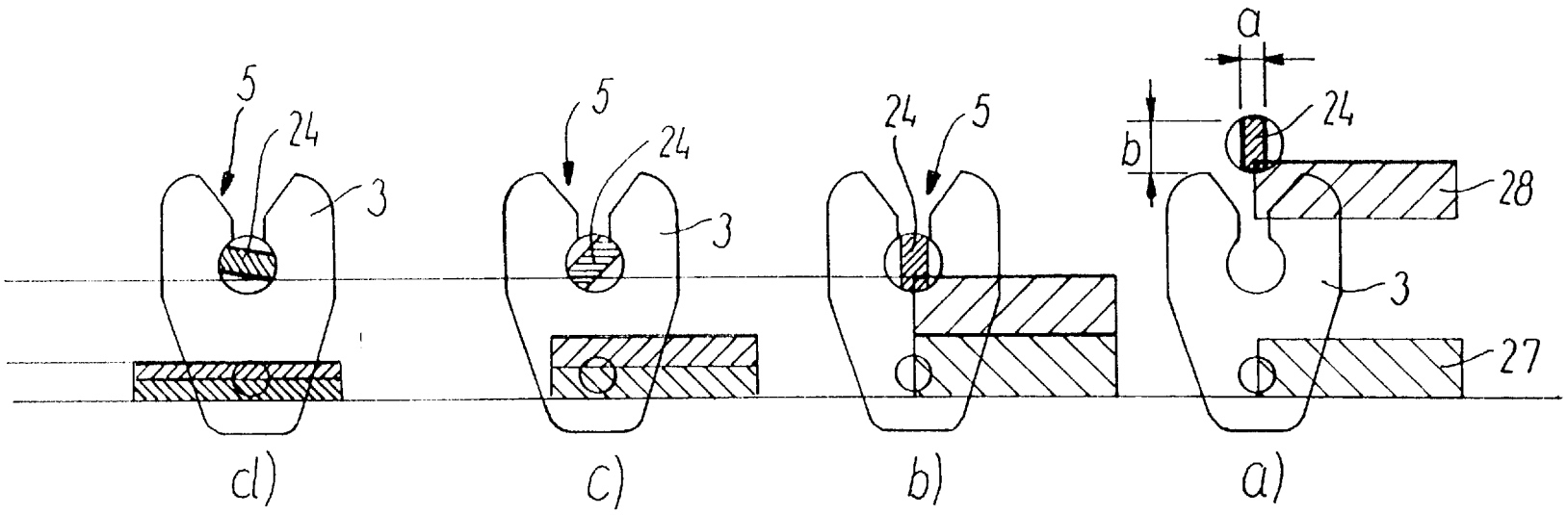
FIG. 4 illustrates the functioning of the embodiment according to FIG. 3 when the first and the second coupling members of the coupling device are coupled in connection with the closing of a window under surmounting of the sealing pressure between oppositely positioned frame and main frame parts.

As shown in FIG. 4 by a-d this embodiment has the effect that in connection with the coupling of the two coupling parts in a situation, where, in the closed position of the window, they are disengaged with a view to opening of the window, by establishing the engagement between the local constriction 24 on the eccentrically displaced part 23 of the shaft section 20 and the keyhole-like recess 5 in the disc-shaped element 3, a tight pull is created between the frame member and the main frame member under surmounting of the sealing pressure which is created by the compression of the sealing element/s 27 and 28 fastened on the frame member and/or the main frame member.

Though the coupling device according to the invention is described above only in connection with an electrically or manually controlled chain operator, the active parts of the coupling device, i.e. the first coupling member with the keyhole-shaped recess and the second coupling member with a shaft section containing a local constriction, it may be used also in connection with other types of mechanical window operators just as the two coupling members by choice may be mounted on either a frame member or a main frame member.

We claim:

1. An openable window with a frame and a main frame, each consisting frame elements, and a manually releasable coupling device connecting an operator means (2) with a frame element of the frame or main frame, wherein the frame is movable relative to the main frame, and the coupling device has a first coupling member (3) connected with a free end of the operator means (2), said free end facing said frame or main frame element, and a second coupling member (6-10) designed for mounting in or on the frame element of the frame or main frame, characterized in that the first coupling member is a flat, disc-shaped element (3*a*), which at one end portion is designed for connection with said free end of the operator means and which at an opposite end portion has a substantially keyhole-shaped recess (5) with a constricted mouth (5*a*) and a circular part (5*b*), the mouth having a width, while the second coupling member comprises a shaft portion (6,20) for mounting in a bore in one of a frame element of the frame, a frame element of the main frame, and a fixture connected with said frame element of the frame or main frame perpendicular to the longitudinal direction said frame element of the frame or main frame, said second coupling member being connected with a turning handle (7, 22), said shaft section (6,20) having a local constriction (8,24) with a substantially rectangular cross-section which in one direction has a dimension (a) corresponding to the width of the mouth of the recess (5) in the first coupling member (3) and in a direction perpendicular thereto a dimension (b) corresponding to the diameter of the circular part (5*b*) of the recess, whereby said second coupling member also comprises means (9,10) for holding said shaft section (6,20) and turning handle (7,22) onto said frame element of the frame or main frame.

2. An openable window according to claim 1, characterized in that the shaft section (29) with associated turning handle (22) in the second coupling member is designed such that a part (23) of the shaft section containing said local constriction (24) has a longitudinal axis (25) positioned eccentrically displaced relative to the rotational axis (26) of the turning handle.

3. An openable window according to claim 2, characterized in that the shaft section (20) is mounted in a flat substantially U-shaped fixture profile (21) for direct fastening on the frame or main frame element.

4. An openable window according to claim 3, characterized in that the operator means is an operator chain (2) for a chain operator built into a main frame element of a window, said chain operator comprising a housing (1) in which the operator chain 2) is receivable in substantially its whole length.

5. An openable window according to claim 2, characterized in that the operator means is an operator chain (2) for a chain operator built into a main frame element of a window, said chain operator comprising a housing (1) in which the operator chain (2) is receivable in substantially its whole length.

6. An openable window according to claim 2, characterized in that the turning handle (7,22) comprises a handle extending substantially perpendicularly to the shaft section.

7. An openable window according to claim 6, characterized in that the operator means is an operator chain (2) for a chain operator built into a main frame element of a window, said chain operator comprising a housing (1) in which the operator chain (2) is received in substantially its whole length.

8. An openable window according to claim 6, characterized in that the shaft section (20) is mounted in a flat substantially U-shaped fixture profile (21) for direct fastening on the frame or main frame element.

9. An openable window according to claim 8, characterized in that the operator means is an operator chain (2) for a chain operator built into a main frame element of a window, said chain operator comprising a housing (1) in which the operator chain (2) is received in substantially its whole length in the closed position of the window.

10. An openable window according to claim 1, characterized in that the turning handle (7,22) comprises a handle extending substantially perpendicularly to the shaft section.

11. An openable window according to claim 10, characterized in that the shaft section (20) is mounted in a flat substantially U-shaped fixture profile 21) for direct fastening on the frame or main frame element.

12. An openable window according to claim 11, characterized in that the operator means is an operator chain (2) for a chain operator built into a main frame element of a window, said chain operator comprising a housing (1) in which the operator chain (2) is received in substantially its whole length in the closed position of the window.

13. An openable window according to claim 10, characterized in that the operator means is an operator chain (2) for a chain operator built into a main frame element of a window, said chain operator comprising a housing (1) in which the operator chain (2) is receivable in substantially its whole length.

14. An openable window according to claim 1, characterized in that the second coupling member is designed for direct mounting in a bore through the frame or main frame element (15, 16) which is made as a hollow element, and in that said holding means comprise a fixture (10) to be fastened on a bottom wall of said hollow element (15) and provided with a guide for an end portion of the shaft section positioned opposite the turning handle (7, 22).

15. An openable window according to claim 1, characterized in that the shaft section (20) is mounted in a flat substantially U-shaped fixture profile (21) for direct fastening on the frame or main frame element.

16. An openable window according to claim 5, characterized in that the operator means is an operator chain (2) for a chain operator built into a main frame element of a window, said chain operator comprising a housing (1) in which the operator chain (2) is receivable in substantially its whole length.

17. An openable window according to claim 1, wherein the disc-shaped element defines a top, a bottom, and a periphery between the top and the bottom, and the constricted mouth opens through said periphery.

18. An openable window according to claim 1, wherein the local restriction of said shaft section, in said one direction, has a dimension substantially equal to the width of the mouth of the recess and, in a direction perpendicular thereto, has a dimension substantially equal to the diameter of the circular part of the recess.

19. A pivotal window with a substantially rectangular main frame and a frame comprising frame elements with a chain operator for opening of the window to a ventilation position, characterized in that a housing (1) for the chain operator is built-in in a main frame member (12) parallel with the axis of rotation of the pivotal movement of the window, that an operator chain (2) of the chain operator is passed through an opening in the main frame member in a direction towards one of the frame elements, that the operator chain has a free end connected with an end portion of a first coupling member shaped as a flat, disc-shaped element (3) which at an opposite end portion has a substantially keyhole-shaped recess (5) with a constricted mouth **(5*a*) and a circular part (5*b*), the mouth having a width, and in that a second coupling member is connected with said one frame element (15, 16), said coupling member comprising a shaft portion (6) for mounting in a bore in said one frame element (15, 16) or in a fixture for fastening thereon and being perpendicular to the longitudinal direction of said one frame element in connection with a turning handle (7), said shaft section (6) having a local constriction (8) with a substantially rectangular cross-section, which in one direction has a dimension (a) corresponding to the width of the mouth (5*a*) of the recess (5) in the first coupling member (3)** and in a direction perpendicular thereto a dimension (b) corresponding to the diameter of the circular part of the recess.

20. A pivotal window according to claim 19, wherein said second coupling member further comprises means for holding said shaft section.

21. A pivotal window according to claim 19, wherein substantially the whole length of the operator chain is received in the housing in the closed position of the window.

22. An openable window with a frame and a main frame, each comprising frame elements, and a manually releasable coupling device connecting an operator means (2) with a frame element of the frame or main frame, wherein the frame is movable relative to the main frame, and the coupling device has a first coupling member (3) connected with a free end of the operator means (2), said free end facing said frame or main frame element, and a second coupling member (6-10) designed for mounting in or on the frame element of the frame or main frame, characterized in that the first coupling member is a flat, disc-shaped element **(3*a*), which at one end portion is designed for connection with said free end of the operator means and which at an opposite end portion has a substantially keyhole-shaped recess (5) with a constricted mouth (5*a*) and a circular part (5*b*), the mouth having a width, while the second coupling member comprises a shaft portion (6,20) for mounting in a bore in one of a frame element of the frame, a frame element of the main frame, and a fixture connected with said frame element of the frame or main frame perpendicular to the longitudinal direction said frame element of the frame or main frame, said second coupling member being connected with a turning handle (7, 22), said shaft section (6,20) having a local constriction (8,24) with a cross-section which in one direction has a dimension (a) corresponding to the width of the mouth of the recess (5) in the first coupling member (3) and in a direction perpendicular thereto a dimension (b) corresponding to the diameter of the circular part (5*b*) of the recess, whereby said second coupling member also comprises means (9,10) for holding said shaft section (6,20) and turning handle (7,22)** onto said frame element of the frame or main frame, the cross-section having two parallel sides.

23. A pivotal window with a substantially rectangular main frame and a frame comprising frame elements with a chain operator for opening of the window to a ventilation position, characterized in that a housing (1) for the chain operator is built-in in a main frame member (12) parallel with the axis of rotation of the pivotal movement of the window, that an operator chain (2) of the chain operator is passed through an opening in the main frame member in a direction towards one of the frame elements, that the operator chain has a free end connected with an end portion of a first coupling member shaped as a flat, disc-shaped element (3) which at an opposite end portion has a substantially keyhole-shaped recess (5) with a constricted mouth **(5*a*) and a circular part (5*b*), the mouth having a width, and in that a second coupling member is connected with said one frame element (15, 16), said coupling member comprising a shaft portion (6) for mounting in a bore in said one frame element (15, 16) or in a fixture for fastening thereon and being perpendicular to the longitudinal direction of said one frame element in connection with a turning handle (7), said shaft section (6) having a local constriction (8) with a cross-section having two parallel sides and having, in one direction, a dimension (a) corresponding to the width of the mouth (5*a*) of the recess (5) in the first coupling member (3)** and, in a direction perpendicular thereto, a dimension (b) corresponding to the diameter of the circular part of the recess.

* * * * *